US006783383B1

(12) United States Patent
Gibboney

(10) Patent No.: US 6,783,383 B1
(45) Date of Patent: Aug. 31, 2004

(54) SAFETY LIGHT SOCKET

(76) Inventor: James W. Gibboney, 3910 Dial Mill Rd., Conyers, GA (US) 30208

( * ) Notice: Subject to any disclaimer, the term of this patent is extended or adjusted under 35 U.S.C. 154(b) by 0 days.

(21) Appl. No.: 10/374,144

(22) Filed: Feb. 25, 2003

(51) Int. Cl.[7] ..... H01R 13/64
(52) U.S. Cl. ..... 439/375
(58) Field of Search ..... 439/375, 384, 439/667, 253–257, 206, 419, 654; 362/294, 290, 276, 249, 288

(56) References Cited

U.S. PATENT DOCUMENTS 3,783,435 A * 1/1974 Fisher ..... 439/340
4,516,054 A * 5/1985 Shikama et al. ..... 315/71
4,548,449 A * 10/1985 Corsetti ..... 439/641
5,176,532 A * 1/1993 Herzog et al. ..... 439/340
5,722,853 A * 3/1998 Hwang ..... 439/419
5,823,322 A * 10/1998 Johnson ..... 200/51.17
6,033,248 A * 3/2000 Lyons ..... 439/257

* cited by examiner

*Primary Examiner*—J. F. Duverne
(74) *Attorney, Agent, or Firm*—Michael A. Mann; Nexsen Pruet Adams Kleemeier, LLC

(57) ABSTRACT

A light socket with a terminal cover and lamp lock is disclosed. This single, molded piece is resiliently attached to the top lip of the socket and is held, cantilevered, over the central terminal. Screwing the lamp into the socket, displaces the cover and lock into a gap formed in the socket threads. Pressure of the resilient lock laterally against the lamp base helps to hold the lamp in place. Contacts that electrically connect the central terminal and line wire conductor and the lamp base and the neutral wire are both formed with lower portions shaped like inverted "Vs" that slice perpendicularly into the insulation to capture their respective conductors in the crotch of the V to assure good contact regardless of whether the conductors are centered in their insulation.

11 Claims, 3 Drawing Sheets

SAFETY LIGHT SOCKET

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable

BACKGROUND OF THE INVENTION

There are a number of different light bulb styles. One particular style is sometimes called a "candelabra" style and includes those standard type light bulbs as the C7, C9, and T50. For convenience, "C7/C9" will be used to designate all candelabra-style lights. The C7 and C9 types they are probably the most popular types of candelabra-style lights for use in holiday lighting, night lights, and decorative lighting systems for homes, restaurants, outdoor events, theme parks, holiday lighting of parks, towns, cities, etc. These bulbs are the small- and medium-sized screw type, threaded bulbs.

The outdoor use of C7/C9 lighting for holiday events, decoration and extravaganzas has steadily increased every year since the mid 80's. The popularity of the larger C7/C9 lamps was very high in the 50's, 60's and 70's when these lamps were used on the interior trees, exterior trees, bushes, and on the home exterior, until the price of electricity suddenly and rapidly increased, making everyone aware of power consumption. As a result, outside holiday decorations declined to almost nothing for years. The larger C7/C9 style, in particular, fell out of favor due to its high power consumption. Gradually, however, more and more holiday decorators started using the more energy efficient miniature light sets, which became very popular since the early 80's because they used 30+% less power.

During the mid 80's, special, for profit, seasonal lighting displays started appearing everywhere. The lack of exterior home decorating created a very profitable business as families wanted to go see lighting displays, once free on homes, now available for a charge in special parks. These parks began using a mix of C7/C9 and miniature light sets and as the parks grew, more and more of them started changing over to the C7/C9 as a primary light source due to the fact that the C7/C9 sets operated electrically in parallel and therefore failed less often compared to the miniature light sets which operated electrically in series. A series lamp failure could mean that half of the lights on a display could go out at one time from the failure of just a single lamp, whereas, the failed lamp in a parallel system would not have this effect on the remaining lamps. The series approach also made trouble-shooting the failed light displays a very difficult task. As most of the miniature lamps are wrapped around metal frames to hold the display's shape, trouble shooting "sniffer" tools developed to find the burned out lamp in a series set were prevented from working properly.

As these light display companies grew larger and larger, the requirement for dependability also grew, so more and more of the displays have been converted over to the C7/C9 sets. The popularity of the C7/C9 sets in the displays has now effected the designing public, so more and more homes are again using the C7/C9 style light sets, especially outdoors as these sets are much stronger and more durable, however, the C7/C9 sets do have their own unique set of problems and dangers. Firstly, the C7/C9 sets operate electrically in parallel and are powered by 120VAC. C7/C9 light sets are fused at 5 and 7 amps when using energy efficient lamps. If a lamp is missing, however, then the lamp socket is open, exposing 120V AC at 5–7 amps. This amperage is easily enough to kill a grown adult. The socket is also large enough for a child to insert a finger into it or for a small bush limb to work its way into the socket. In either of these cases the outcome of such a contact be dangerous and possibly fatal; also, they can cause an electrocution or a fire as a to a limb.

In one of these sockets, there is a two-part center (AC Line) terminal. The upper portion of this terminal (namely, the part that contacts the lamp) is a special copper alloy and is slightly bent upwards with one end bent downward towards the bottom of the socket to form a switch contact. Under the downward-bent part is the second part of this two-part terminal. The second terminal is made of brass and pierces the electrical wire under it. When a lamp is screwed into the socket, the center contact of the lamp engages the center terminal of the socket, compressing the downward-bent part of the terminal until it comes into contact with the energized second part of the terminal under it. Then the lamplights. However, this approach has several problems, and that often cause the lamps to fail to light.

Secondly, in order to reduce the manufacturing cost of the new C7/C9 sets, manufacturers are using molded plastic sockets rather than a metal screw base internal to the design. The threads molded in the socket are molded in sections, usually two, and only cover about 50% of the internal surface of the lamp base. The threaded sections are separated by cavities where there are no threads. One of these cavities has a thin, flat piece of metal (brass) running up the cavity, perpendicular to the threads. This metal bar contacts the threaded conducting base of the lamp by contacting the tips of the threads on the lamp as the bulb is screwed into the socket.

There is in the industry, especially due to price sensitivity, a considerable lack of uniformity in lamp base diameters and length. When a lamp is replaced with another lamp made by another manufacturer, it may not fit properly. If this replacement lamp is a little smaller in diameter then the lamp that it replaced, the quality of the electrical contact with this metal strip is poor at best, so lamp failure is immediate or inevitable. When a larger diameter lamp is screwed into the socket, it compresses this metal strip and, because this metal strip is made of brass, there is no return memory, so it stays compressed. This worsens the contact problems with other replacement lamps, plus the inability to get the lamp tight in the socket means that it will loosen more rapidly, failing even sooner.

The reduction of thread surface area reduces the ability of the socket to properly hold the lamp. Likewise, because the socket is plastic, and the C7/C9 lamps radiate so much heat, the sockets are constantly expanding and contracting. This expansion/contraction cycle is enhanced by the fact that most C7/C9 lamps hang downward, with the base directly in the path of the thermal given off by the bulb in the socket. This thermal coupled with normal temperature changes loosens the lamp via these expansion/contraction cycles. As the lamp loosens, the electrical contact fails first, then, especially outdoors, the loose lamp condition worsens from the wind and weather conditions swinging and moving the lamps, plus the expansion/contraction cycle. Everyone has attempted to replace a bad lamp at home only to find, when tightened, the lamp turns back on, that it was not burned out but only loose. This loosening happens in a full metal socket in doors, in an environment of constant temperature—imagine what a plastic socket does when exposed to dramatic temperature changes, especially if the lamps are hanging upside down, which is the normal case regarding C7/C9 lamps due to their weight and simple fastening system.

Thirdly, still further cost cutting forces the manufacturer to use a very inexpensive method for connecting the metal conductors in the socket to the appropriate power lines. Electrical connection is achieved by forming the bottom of the socket terminals into spear pointed shapes which stick out of the bottom of the socket far enough to "pierce" the wire insulation and to make contact with the copper wire within, then a 'snap in' socket bottom is attached securing the wires to the socket. Nearly all of the C7/C9 sets use AWG 20, multi-strand wire. The plastic insulation is typically 2.4 mm in diameter, so the copper core being 20 AWG is very small in diameter compared to the plastic insulation. When the vinyl insulation is extruded onto the copper wire, the wire is somewhere near the middle of the vinyl coating if the machine is running properly. Just a slight change in wire feed of plastic extrusion, however, will cause the wire to be off-center in the insulation. Because the copper wire is never exactly in the middle of the insulation, the 'piercing terminals' sometime miss or barely touch the copper wires. This causes the lamp to go on and off erratically or fail altogether, and is, in fact, one of the highest failure mechanisms to the C7/C9 sets. Also, partial or poor contact causes the wires to heat up and possibly burn during arcing inside the insulation.

In summary, there are problems with the C7/C9 sockets. These are:

1) C7/C9 sets are in parallel and are powered by 20 VAC, with electrical current limited by a slow blow, 5 7 amp fuse. An open socket is hazardous and could mean a severe, or lethal, electrical shock, or could be the energy source to start a fire in a bush or tree.
2) Some of the latest methods, in use today, use a 2 part center (AC Line) terminal that acts as a normally open switch, so when a lamp is missing, the center contact is suppose to open and disconnect from the power source. This terminal switch is made from a special copper that has a light spring action. If a replacement lamp is screwed into the base too far, it will compress this terminal beyond it's ability to open, effectively defeating the normally open switch condition, thus leaving power applied to the center conductor when the lamp is removed, lost or missing. In addition to this failure mechanism, the center conductor's copper spring contact requires very little force to close, so a small finger or limb can easily compress it enough to energize it.
3) A partially closed center terminal switch will arc. This arc can cause fire. This arcing will occur as the lamp loosens from expansion and contraction cycles.
4) This center terminal switch is subject to corrosion and poor contact and ultimately premature lamp failure due to condensation forming inside the socket as it cools. Likewise, this condition is exacerbated by rain or melted ice and snow, easily leaking into the socket due to poor sealing.
5) Threads in the C7/C9 sockets are formed into the plastic socket. These threads are partial, usually only 50% radius: 25% threads, 25% blank, 25% threads, 25% blank, running two thirds (⅔) to three quarters (¾) of the depth of the socket. The reduction and interruption of threaded surface area reduces the ability of the socket to properly hold the lamp tightly, therefore allowing it to loosen quickly and fail to light or fall out.
6) The reduction and interruption of threaded surface area reduces the ability of the socket to properly seal to the bulb, and thereby to withstand inclement weather that can corrode internal components and accelerate premature lamp failure.
7) When a lamp is replaced with a general replacement lamp, there is a very good chance that the replacement lamp will not fit properly. If this replacement lamp is a little smaller in diameter, then the ability of the lamp to establish good contact with the AC neutral sidewall metal strip is poor at best, so lamp failure is immediate or inevitable. When a larger diameter lamp is screwed into the socket, it compresses this brass sidewall metal strip and because it is brass, there is no return memory, so it stays compressed. This worsens the contact problems with other replacement lamps, plus the inability to get the lamp tight in the socket means that it will loosen itself more rapidly, failing sooner then normal. Likewise, this can also cause internal arcing between the lamp base and the sidewall AC neutral power strip.
8) Due to the small gauge (20 AWG) wire used, the electrical contacting method using single piercing terminals is undependable because the copper wire is never exactly in the middle of the insulation. The 'piercing terminals' will sometimes miss or barely touch the copper wire. This causes the lamp to go on and off erratically or fail altogether, and is in fact one of the highest failure mechanism to the C7/C9 sets. Partial or poor contact also causes the wires to heat up and burn from arcing inside the insulation as poor contacts worsen producing arcs caused from stress due to temperature changes and movement of the set during wind, ice and snow loads, and storms.

Thus there remains a need for an improved C7/C9 light socket.

SUMMARY OF THE INVENTION

Briefly recited, the present safety light socket overcomes the aforementioned problems by the use of several features in its design. Specifically, the C7/C9 Safety Socket has a nearly fully threaded interior to assure maximum seal between bulb and socket for the best possible weather resistance. It has a molded in, threaded, center terminal cover and lamp lock. This cover-and-lock component is molded in such a fashion that when the lamp in screwed into the socket, the cover-and-lock are pressed into a slot in the sidewall of the socket and held under constant pressure between the C7/C9 lamp base and the socket wall.

This design achieves several goals: by keeping constant pressure on the lamp base, and by having the threaded portion of the cover-and-lock formed with slightly oversized threads, the lamp becomes locked into the socket. Expansion/contraction cycles have no effect on the lamp as it is held at a constant pressure during expansion and the dissimilar thread sizes restrict turning ease so lamps are less likely to work themselves free.

When a lamp is removed, the terminal cover-and-lock expands to cover the center terminal, thereby helping to preventing accidental electrical contact. The larger threads on this part are rounder on the upper surface to help restrict penetration of foreign objects by having them slide off and veer off one or more of the threads to prevent full insertion, but still allow the threads to restrict fingers from entering the socket far enough to reach the center terminal. Due to the design, compression of this part requires considerable pressure, easily generated by the mechanical compression generated via the screw action of the lamp, but not easily generated by outside sliding/pushing motions from naturally occurring foreign objects such as bush or tree limbs.

The present invention uses double, 'insulation displacement' type electrical contacts. Insulation displacement type contacts cut partially through the insulation using an inverted "V" shape interior groove. This "V" shape groove 'captures' the center conductor in the wire, whether it is off-center or not, and traps the copper conductors in the center of the "V" , tightly forming a "Gas" fit. This contact keeps the electrical surfaces from oxidizing, thus preventing corrosion, arcing, and the resultant lamp failure, even if condensation forms internal to the socket. Each electrical contact has two of these insulation displacement contacts to assure the best possible connection.

Double, "insulation displacement" type electrical contacts also grip and hold the electrical wires better then the piercing type contact. 'Insulation displacement' type electrical contacts maximize the pull strength of the socket so it is not easily moved along the conductors, as the insulation displacement "V" groove does not allow the wire insulation to be pulled through it, unlike the piercing type of contact which slices the wire insulation like a knife if the wires are pulled and the socket slides along the wires, thus exposing bare electrical wires and compromising safety.

These and other features and their advantages will be apparent to those skilled in the art of lighting systems from a careful reading of the Detailed Description of Preferred Embodiments, accompanied by the following Drawings:

DETAILED DESCRIPTION OF PREFERRED EMBODIMENTS

The present invention is a safer socket for use with C7/C9 lamps. It is also a light comprising a socket and lamp.

Figure 2:
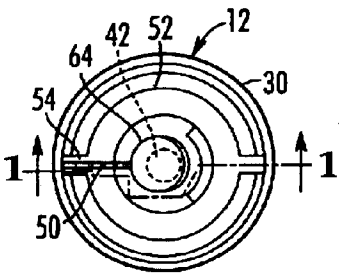
FIG. 2 is a top view of alight socket of FIG. 1 without a lamp, according to a preferred embodiment of the present invention.
Figure 1C:
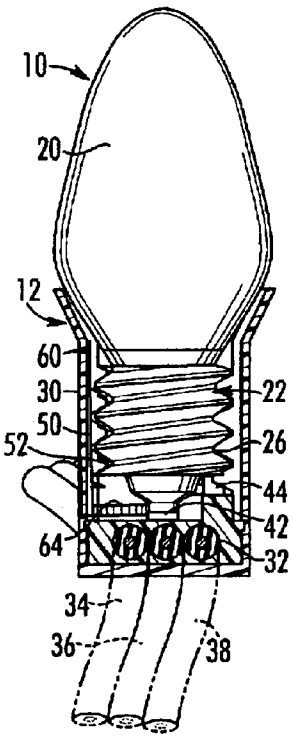
FIGS. 1A, 1B and 1C illustrates a side cross sectional view a lighting socket according to a preferred embodiment of the present invention, with FIG. 1A showing a light bulb prior to being screwed into the present socket, FIG. 1B showing the light bulb partially screwed into the light socket, and FIG. 1C showing the light bulb completely screwed into the socket.
Figure 1B:
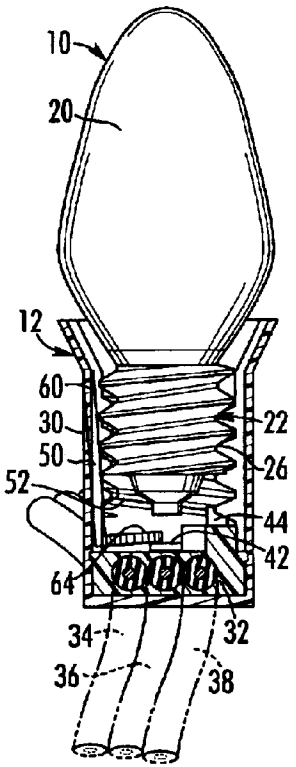
Figure 1A:
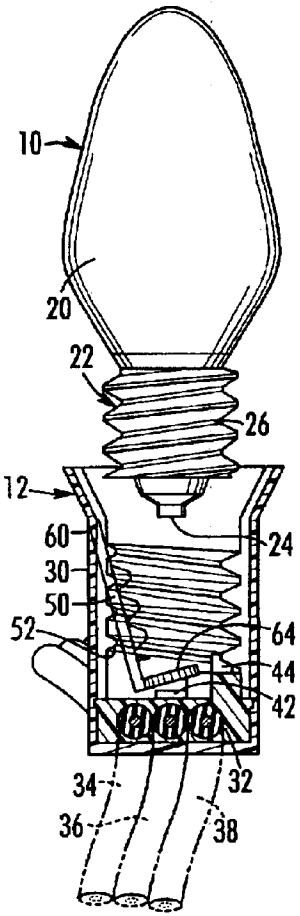

FIGS. 1A, 1B, and 1C show a lamp 10 initially outside of, then partially threaded into and finally fully seated into a socket 12. Lamp 10 includes a transparent lamp bulb 20, a lamp base 22 and a lamp terminal 24. Exterior threads 26 are formed in electrically conducting lamp base 22. Lamp 10 is in every way a standard C7/C9 lamp.

Socket 12, however, is not a standard socket for a C7/C9 lamp. Socket 12 includes a housing 30 with a wire cavity 32. Three wires 34, 36, and 38 pass through cavity 32 but two may suffice for many applications. Wire 34 is the line voltage wire; wire 38 is the neutral wire; and wire 36 is the third wire. There are two wire contacts, a line contact 42 and a neutral contact 44 for placing line and neutral wires 34, 38, in electrical connection with lamp terminal 24 and lamp base 22, respectively. An electrical circuit is then established between line and neutral wires 34, 38, through contact 42, lamp terminal 24, the filaments inside lamp bulb 20 and then lamp base to contact 44.

Socket 12 also includes a resilient lamp lock-and-cover 50. Housing 30 has interior threads 52 that nearly encircle the interior of socket 12 except for a small gap 54. Lock-and-cover 50 extends resiliently into the interior of socket 12 from a first end 60 where it is attached to a lip 62 at the top of socket 12, preferably attached integrally. The opposing or second end 64 of lock-and-cover 50 is cantilevered downward until it is just over line contact 42, and is preferably flared so that it covers all of the upper surfaces of line contact 42. Preferably lock-and-cover 50 is sufficiently rigid so that it requires more force than that normally exerted by a child sticking a finger into socket 12.

As lamp 10 is threaded into socket 12, lamp base 22 presses lock and cover 50 into gap 54 to uncover line contact 42 and enable lamp terminal 24 to make electrical contact therewith, once lamp 10 is fully seated in socket 12 (FIG. 1C). The pressure of lock-and-cover 50 against lamp base 22 help to hold lamp 10 securely in socket 12.

Lock-and-cover 50 is rippled with threads 66, preferably slightly larger than interior threads. When lamp 10 in inserted and fully seated in socket 12, lock-and-cover 50 acts as a locking mechanism by resisting the unscrewing of lamp 10.

Figure 3:
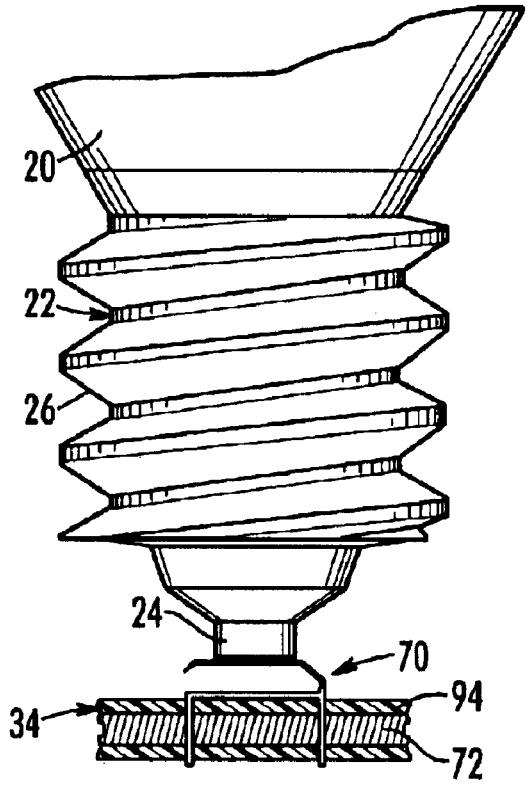
FIG. 3 is a side, partially cross sectional view of a contact to connect the center terminal of the bulb to the line wire, according to a preferred embodiment of the present invention.
Figure 4A:
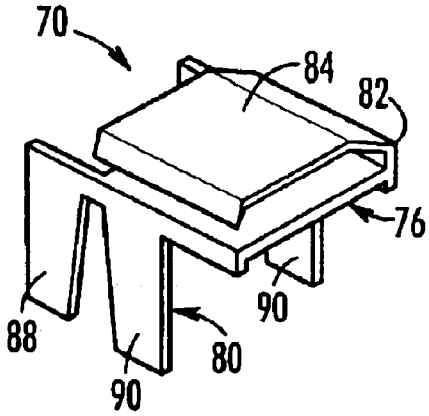
FIGS. 4A and 4B are perspective side and rear views of the center contact of FIG. 3.
Figure 4B:
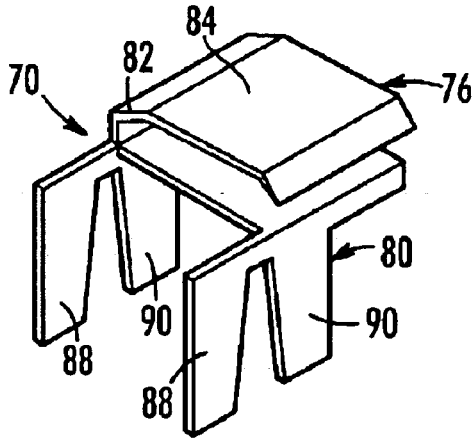

FIGS. 3 and 4A and 4B illustrate the central terminal contact 70. This contact 70 is the electrically conducting device that makes electrical contact with the central terminal 24 of lamp base 22 and with the conductor 74 in line wire 34. Central terminal contact 70 is formed of a single sheet of conducting, and preferably resilient, material such as metal, preferably copper, that is die cut and formed into an upper portion 76 and a lower portion 80. The upper portion 76 has a fold 82 to create a spring surface 84 that will remain engaged with the central terminal 24 of lamp 10 even if it is a little longer or shorter or lamp 10 is screwed into socket 12 a little more or a little less.

Figure 5A:
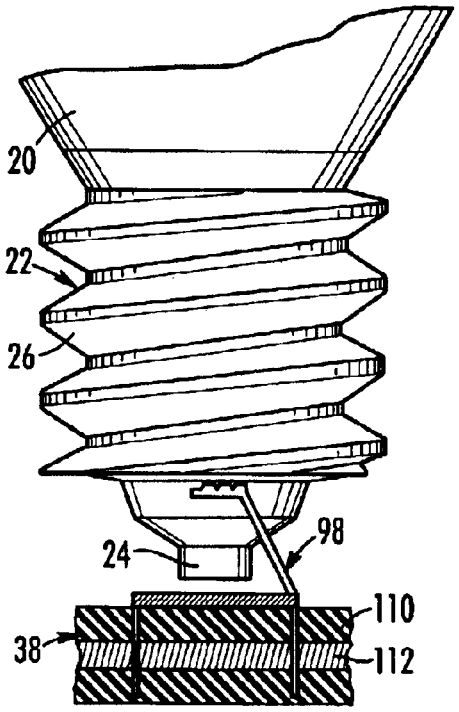
FIGS. 5A and 5B are side and end views of the neutral contact that connects the base of the bulb to the neutral line wire, according to a preferred embodiment of the present invention, FIG. 5A being a partial cross sectional view of FIG. 5B taken along lines 5*a*—5*a*.
Figure 5B:
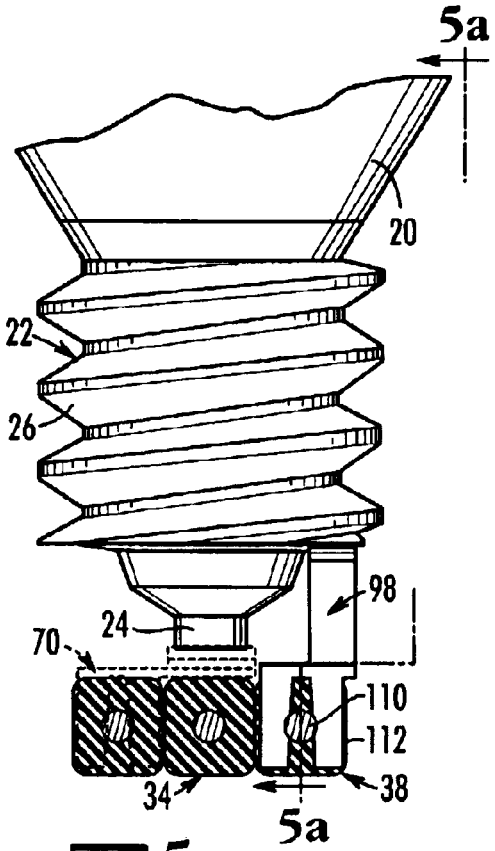
Figure 6:
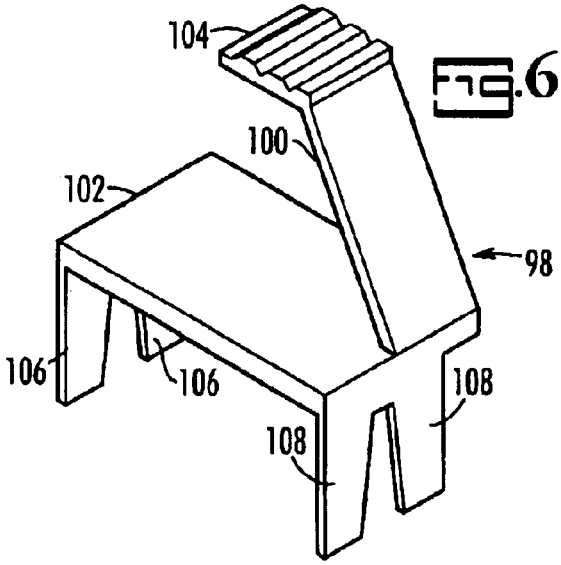
FIG. 6 is a perspective view of the neutral contact in engagement with a bulb.

The lower portion 80 is formed to have two displacement insulation type electrical contacts 88, 90, which look like inverted "Vs". These slice through the insulation 94 of line wire 34 in a direction perpendicular to the axis of the wire 34 to capture the electrical conductor 74 in the crotch of the "V". Regardless of whether the conductor 74 is centered in line wire 34 or not, it will be captured by lower portion 80 and brought into electrical contact with central terminal 24 via upper portion 76. FIGS. 5A, 5B and 6 illustrate a neutral contact 98 which, like central contact 70, is preferably made of a sheet of electrically conducting and resilient material that can be die cut and folded to the desired shape, as shown. Neutral contact 98 also has an upper portion 100 and a lower portion 102. The upper portion 100 is formed to be a spring 104 that engages lamp base 22 when lamp seated. Lower portion 102 is formed to provide a double displacement type electrical that, again like contacts 88, 90 of central terminal 70, slice through insulation 110 to conductor 112 in neutral wire 36. Lower portion 102 is doubled to further assure proper good, redundant contact. Thus, electrical contact is established between lamp base 22 36 via upper portion 100 and lower portion 102 of neutral contact 98. Note that neutral contact's 98 upper portion 100 and lower portion 102 are off set with respect to each other in the three-wire configuration shown. In a two-wire configuration, upper portion and lower portion can be aligned.

Those skilled in the art of lighting, particularly holiday lighting, will appreciate that many modifications and substitutions may be made to the just-described preferred embodiments without departing from the spirit and scope of the present invention, which is defined by the appended claims.

What is claimed is:

1. A socket for use with a lamp, said lamp having a threaded base, said socket comprising:

a housing having interior threads for threadably receiving a threaded base of a lamp;

an electrical conductor carried by said base and having a center terminal; and means carried by said housing for resiliently covering said center terminal, said covering means being urged away from said center terminal upon threading said threaded base of said lamp into said housing so that, when said lamp is fully threaded into said housing, said lamp is in electrical connection with said center terminal.

2. The socket as recited in claim 1, wherein said covering means is molded to said housing.

3. The socket as recited in claim 1, wherein said housing has a slot formed therein and wherein said covering means is compressed into said slot when said lamp is threaded into said housing.

4. The socket as recited in claim 1, wherein said covering means is formed to have threads.

5. The socket as recited in claim 4, wherein said threads of said covering means are larger than the threads of said housing.

6. A socket for usc with a lamp, said lamp having a threaded base, said socket comprising:

a housing having interior threads for threadably receiving a threaded base of a lamp;

an electrical conductor carried by said base and having a center terminal; and means carried by said housing for resiliently urging said threaded base of said lamp to remain in said housing so that said lamp remains in electrical connection with said center terminal while inserted into said housing.

7. The socket as recited in claim 6, wherein said urging means presses said lamp base against said housing.

8. The socket as recited in claim 6, wherein said covering means is molded to said housing.

9. The socket as recited in claim 6, wherein said housing has a slot formed therein and wherein said covering means is compressed into said slot when said lamp is threaded into said housing.

10. The socket as recited in claim 6, wherein said covering means is formed to have threads.

11. The socket as recited in claim 10, wherein said threads of said covering means are larger than the threads of said housing.

* * * * *